United States Patent [19]

Homan et al.

[11] 4,103,119

[45] Jul. 25, 1978

[54] TIMING MECHANISM HAVING INDEPENDENTLY OPERATED PLURAL CAM ASSEMBLIES

[75] Inventors: William N. Homan, Plainfield; Steve W. Smock, Indianapolis, both of Ind.

[73] Assignee: P. R. Mallory & Co. Inc., Indianapolis, Ind.

[21] Appl. No.: 731,622

[22] Filed: Oct. 12, 1976

[51] Int. Cl.[2] ..... H01H 43/10

[52] U.S. Cl. ..... 200/35 R; 200/38 R; 200/38 B

[58] Field of Search ..... 74/3.5, 3.52, 3.54, 74/568 M, 568 T; 58/7, 21.1, 21.11, 21.15, 21.155, 22, 22.5, 22.7, 22.9, 23 D, 125 R, 125 B, 125 C; 200/35 R, 38 R, 38 B, 38 BA, 38 C, 38 CA, 153 L, 153 LB, 153 P

[56] References Cited

U.S. PATENT DOCUMENTS

| | | | |
|---|---|---|---|
| 2,870,834 | 1/1959 | Sisson | 200/38 BA X |
| 3,192,699 | 7/1965 | Stout | 58/21.15 X |
| 3,246,088 | 4/1966 | Maunder | 200/153 P X |
| 3,493,233 | 2/1970 | Foufounis | 200/153 P X |
| 3,735,062 | 5/1973 | Chestnut et al. | 200/38 B X |
| 3,988,885 | 11/1976 | Flumm et al. | 58/22.9 X |

*Primary Examiner*—James R. Scott

*Attorney, Agent, or Firm*—Hoffmann, Meyer & Coles

[57] ABSTRACT

Two separate cam means are fixedly and freely rotatably carried on a shaft. Each cam means are simultaneously rotated by a motor at different speeds through a gear train having two separate outputs. Cam lobes are carried on each cam means and engage switch means to open and close same as the cam means are rotated.

7 Claims, 3 Drawing Figures

TIMING MECHANISM HAVING INDEPENDENTLY OPERATED PLURAL CAM ASSEMBLIES

BACKGROUND OF THE INVENTION

Generally speaking, the present invention relates to an improvement in a timing mechanism wherein at least two separate cam means are carried by a shaft, and wherein a motor drive means causes rotation of the cam means, the improvement being characterized by a first cam means fixedly connected to the shaft, second cam means freely rotatable about the shaft, and coupling means coupling the motor drive means to the shaft and the second cam means, the coupling means adapted to permit the first and second cam means to be simultaneously rotated at different speeds.

This invention relates, in general, to a timing mechanism and in particular to a timing mechanism particularly adaptable for controling a laundry dryer through a timed fabric treatment cycle.

Some automatic clothes dryers include an anti-wrinkle control system that provides for rearranging and refluffing permanent press fabrics every few minutes if they are not removed from the dryer at the end of the automatic or timed drying period. More specifically, at the end of a permanent press cycle, a buzzer sounds to remind a housewife, for example, that her clothes are ready. If she is busy or out of the home, the anti-wrinkle control starts the dryer at predetermined intervals, for example every five minutes and tumbles the clothes for a predetermined interval, for example, 10 seconds. At the end of each 10 seconds of tumbling, the dryer again buzzes to remind the housewife to remove the clothes. The dryer continues to "nag" in this manner for a predetermined period of time, for example, up to two and one half hours. However, for the times illustrated, total running time for the dryer would only be five minutes.

One system providing an anti-wrinkle portion of a drying cycle employed two timer motors. One motor drove the timer cams which sequentially operated the dryer at a constant speed, while a second "pulser" motor drove a cam to intermittently complete a circuit to the timer motor to advance the timer cams intermittently and to complete a circuit and intermittently cycle the main dryer motor operating the dryer and to run out the timer motor until a predetermined accumulative minutes of timer "on time" has expired a "two motor" timer useful for such a system as described in U.S. Pat. No. 3,732,383 issued May 8, 1973. Because of the decreasing amount of available space required in automatic clothes dryer operation and because of the increased amount of cost of the additional motor, it has become highly desirable to replace this conventional method of operation with a system utilizing only the single timer motor.

FEATURES OR OBJECTS OF THE INVENTION

The present invention, therefore, is concerned with a timing mechanism which is particularly adaptable to the operation of an automatic clothes dryer having an anti-wrinkle control system and has as one of its features the provision of a timing mechanism which is neat, compact, and relatively low in cost. Another feature of the invention is the provision of a timing mechanism which utilizes a single motor drive means to rotate two separate cam means simultaneously at different speeds. Another feature of the invention is to provide such a timing mechanism wherein there is a means coupling a single motor to the individual cam means and which is adapted to permit the cam means to simultaneously run at different speeds. Still another feature of the invention is the provision of such a timing mechanism wherein a first cam means is fixedly carried by a shaft and a second cam means if freely rotatable about the shaft, the two cam means being driven by a single motor simultaneously at different speeds. Yet another feature of the invention is the provision of such a timing mechanism wherein the single motor is connected to the separate cam means through a gear train having two separate output pinions. Another feature of the invention is the provision of a motor drive means having a gear train with two separate output pinions. These and other features of the invention will become apparent from the following description taken in conjunction with the accompanying drawings.

DETAILED DESCRIPTION OF THE INVENTION

Figures 1, 2, 3:
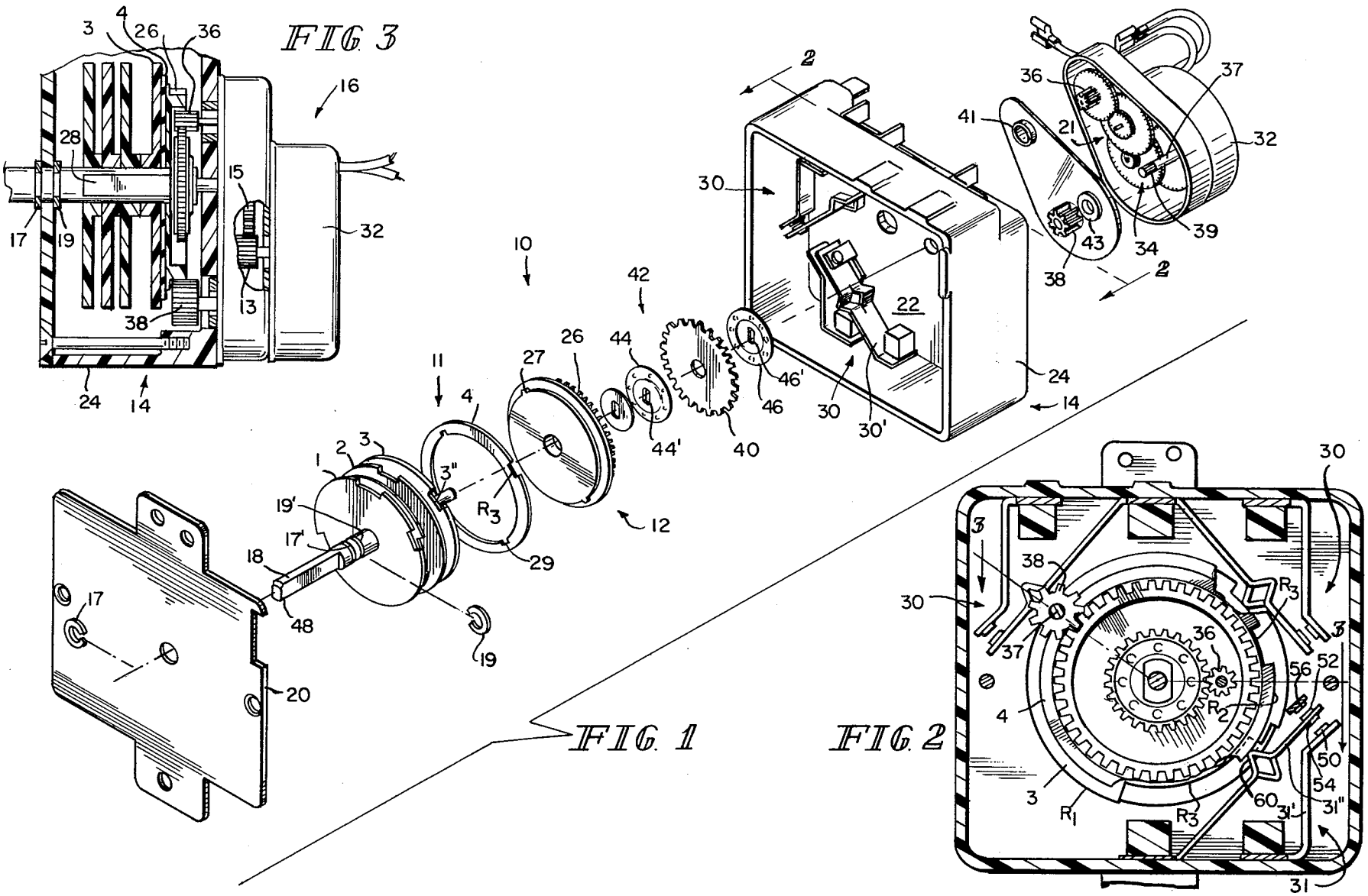
FIG. 1 is an exploded view of the timing mechanism.
FIG. 2 is a section of the timing mechanism taken along line 2—2 of FIG. 1.
FIG. 3 is a partial section taken along the line 3—3 of FIG. 2.

Referring now to the drawings, timing mechanism 10, in general, includes a timer section 12 carried in a housing 14 and a motor drive section 16 carried on the outside of the housing. A cam assembly 11 is carried on a shaft 18. Shaft 18 is rotatably journalled in end plates 20 and 22, end plate 22 being the bottom portion of cup shaped member 24 and end plate 20 providing a cover which closes the cup shaped member. Axial displacement of the shaft is prevented through C-rings 17 and 19 engaging grooves 17' and 19' on either side of end plate 20. Cam assembly 11 includes a first cam means consisting of cams 1–3 each fixedly carried on the shaft through a double-D aperture mating with the double-D portion 28 of the shaft. The cam assembly also includes a second cam means consisting of cam 4 which is coupled to drive gear 26 through cooperating splines 27 and notches 29. Gear 26 is freely rotatable about the shaft; thus cam 4 is freely and independently rotatable about the shaft. Each of the cam means are driven separately but simultaneously through motor drive 16. Rotation of the cam means causes switch means 30 to open and close in accordance with the cam lobes associated therewith.

Motor drive means 16 includes a motor 32, generally of the synchronous type, and a speed reducing means consisting of a gear train 34 coupled to the motor. As shown, gear train 34 includes an input gear 15 engaging an output pinion 13 of motor 32, and a series of cooperating gears and pinions 21 coupling two separate output pinions 36 and 38 provided at different stages of the gear train. Therefore two different output speeds are provided simultaneously, with pinion 36 providing a slower output speed. Pinion 36 extends through aperture 41 and engages drive gear 40 which is freely rotatable about shaft 18. The drive gear 40 is coupled to the shaft through a clutch means 42 which includes a pair of spring washers 44 and 46 which frictionally engage opposed faces of the gear 40 and are fixedly carried by shaft 18 through double D-apertures 44' and 46'. Thus output pinion 36 drives shaft 18 and thus cams 1–3 at one speed. The use of the clutch means 42 permits the shaft 18 and thus the cam means 1–4 to be manually set through a knob (not shown) carried on the end 48 of the shaft. Pinion 38 is fixedly carried on shaft 37 through splines 39 and extends through aperture 43. The pinion engages drive gear 26 which, as previously noted, is freely rotatable about the shaft 18 so as to be rotatable independently of the shaft. Since cam 4 is coupled to gear 26, it is rotated independently of shaft 18 at the speed of output pinion 38.

In operation, the slower output pinion 36 rotates cams 1–3 at a predetermined speed through drive gear 40 while output pinion 38 rotates cam 4 at a faster speed through drive gear 26. Cam 3, in addition to providing other functions, cooperates with cam 4 to provide three working radii: $R_1$ of cam 3, $R_2$ of cam 3 and 4, and $R_3$ of cam 3 and 4. Switch 31 is responsive to the combination of cams 3 and 4 and comprises a fixed blade 31' carrying fixed contact 50, movable blade 31'' carrying contacts 52 and 54, cam follower 60, and fixed contact 56. Follower 60 is responsive to both cams. With the follower riding on surface $R_2$ (cam 3 and 4) as shown, no contacts are engaged. With the follower engaging surface $R_1$ (cam 3) contacts 50 and 54 are closed. With the two surfaces $R_3$ and cams 3 and 4 coinciding at the follower, contacts 52 and 56 are closed. And since cam 4 is rotating faster, contacts 52 and 54 will be open and closed many times during the period that the follower is "in line" with $R_3$ of cam 3. This provides selective pulsing which may be used in anti-wrinkle control, for example.

What is claimed is:

1. In a timing mechanism wherein at least two separate cam means are carried by a shaft and wherein a single motor drive means causes rotation of said two separate cam means, an improvement characterized by:

(a) a first cam means fixedly connected to said shaft and a first switch means engaging same to be opened and closed in response to a rotation of said cam means, (b) a second cam means freely rotatably carried about said shaft and a second switch means engaging both said first and second cam means, (c) a gear train coupled to said motor drive means, said gear train including first and second output pinions at separate stages thereof to provide two separate outputs at different speeds, and (d) first coupling means coupling said first output pinion to said shaft and second coupling means coupling said second output pinion to said second cam means whereby said shaft and said first cam means are rotated at one speed and said second cam means is rotated simultaneously about said shaft at a different speed.

2. In a timing mechanism according to claim 1 wherein said first coupling means comprises a first gear engaging said first output pinion and carried about and coupled to said shaft to be rotatable therewith.

3. In a timing mechanism according to claim 2 wherein said gear is coupled to said shaft through a clutch permitting manual rotation of said shaft independent of said single motor drive means.

4. In a timing mechanism according to claim 1 wherein said second coupling means comprises a second gear engaging said second output pinion and is freely rotatable about said shaft and connected to said second cam.

5. In a timing mechanism according to claim 4 wherein said second gear is connected to said second cam means by cooperating splines and notches provided on said cam means and said second gear.

6. In a timing mechanism according to claim 1 wherein said second switch means is a double throw switch.

7. In a timing mechanism according to claim 1 wherein three radii are provided by a first cam of said first cam means and second cam of said cam means, a first radius provided on said first cam, second and third radii on each of said first and second cams, and wherein said third radius of each said first and second cams become selectively in line with each other.

* * * * *